United States Patent [19]

Sexton et al.

[11] 4,361,268

[45] Nov. 30, 1982

[54] SLEEVE CONSTRUCTION FOR A BAG HAVING A FILLING OPENING

[75] Inventors: Dennis F. Sexton; Richard J. Hadaskay, both of Camden, Ark.

[73] Assignee: International Paper Company, New York, N.Y.

[21] Appl. No.: 245,313

[22] Filed: Mar. 19, 1981

[51] Int. Cl.[3] ..... B65D 30/24

[52] U.S. Cl. ..... 229/62.5; 150/9

[58] Field of Search ..... 229/62.5; 150/9; 141/68, 10, 76, 315, 114

[56] References Cited

U.S. PATENT DOCUMENTS

| | | | |
|---|---|---|---|
| 1,476,560 | 12/1923 | Witmer | 229/62.5 |
| 3,000,551 | 9/1961 | Atwood | 229/62.5 |
| 3,022,932 | 2/1962 | Vines | 229/62.5 |
| 3,894,682 | 7/1975 | Harmsen | 229/62.5 |
| 4,049,191 | 9/1977 | Stearley | 229/62.5 |
| 4,111,354 | 9/1978 | Brünker | 229/62.5 |

FOREIGN PATENT DOCUMENTS

| | | | |
|---|---|---|---|
| 836432 | 3/1952 | Fed. Rep. of Germany | 229/62.5 |
| 842586 | 5/1952 | Fed. Rep. of Germany | 229/62.5 |
| 867493 | 1/1953 | Fed. Rep. of Germany | 229/62.5 |
| 1298441 | 6/1969 | Fed. Rep. of Germany | 229/62.5 |
| 635663 | 3/1962 | Italy | 229/62.5 |
| 109428 | 10/1943 | Sweden | 229/62.5 |

*Primary Examiner*—William Price
*Assistant Examiner*—Gary E. Elkins
*Attorney, Agent, or Firm*—Luedeka, Fitch & Neely

[57] ABSTRACT

A deflecting member construction is disclosed for a bag having an end closure which has a filling passageway at one end of the end closure through which a bulk material is conveyed into the bag. The deflecting member has an elongated section extending into the bag from the inner end of the passageway. The section has two longitudinally extending folded under flaps and is folded back at one end.

2 Claims, 16 Drawing Figures

SLEEVE CONSTRUCTION FOR A BAG HAVING A FILLING OPENING

The present invention relates to bags made of paper or other flexible material which are adapted to contain bulk materials, such bags being provided with filling passageways for receiving the nozzle or spout of a bag filler and, more particularly to a deflecting member disposed at the filling passageway as an aid in minimizing the loss of material when the bag is being filled.

Deflecting members of various types for use in bags having a filling opening are known. For example, one type is merely a length of kraft paper that is glued to the top of the bag at the filling passageway and functions to reinforce the bag so that the bag corners will not tear when the bag is suspended from the filling spout of a bag filling machine. Another type deflecting member sleeve is, for example, in the shape of a tube located in the filling passageway of the bag. The tube is expandable and collapsible so that it can be expanded to receive the filling spout of a bag filling machine and will collapse thereby sealing the filling passageway of the bag when the filling spout of the bag filling machine is removed.

In the manufacture of bags of the class described, it is desired that the bag is provided with material-tight seams so that the material in the bag does not escape. However, due to imperfections in the bag-making operations the adhesive or other means employed to seal the seams does not always make a perfect seal. In this event, the material such as cement, fertilizer, grain, flour and the like may escape through these imperfections during the filling operation. This condition is particularly prevalent in connection with the seals and overlaps at the corner of the bag opposite the filling passageway since the material from the filling spout impinges upon them to a substantial degree.

An object of the present invention is to provide a deflecting member which is operable to direct the material from the filling spout away from the seals and overlaps at the corner of the bag opposite the filling spout and to cover those seals and overlaps in the event that the flow of material into the bag displaces the deflecting member to a maximum extent.

A further object of the invention is to provide a deflecting member for minimizing loses from the bag during filling which may be provided at a minimum cost.

It has been discovered that the escape of the material from the seams of a bag having an end closure with a filling passageway at one end thereof can be minimized by providing a deflecting member at the end of the filling passageway, the deflecting member including a section extending inwardly into the bag from the inner end of the filling passageway; the section including an inwardly extending panel having folded under flaps along the marginal edges, and the innermost end of the section being folded back upon itself, whereby when the material is directed through the filling passageway it impinges on the folded end of the section to cause it and the marginal edge folded under flaps to assume a position to direct the material into the interior of the bag away from the other end of the end closure.

Other objects and advantages of the present invention will become known upon reference to the following description and drawings in which.

Figure 1:
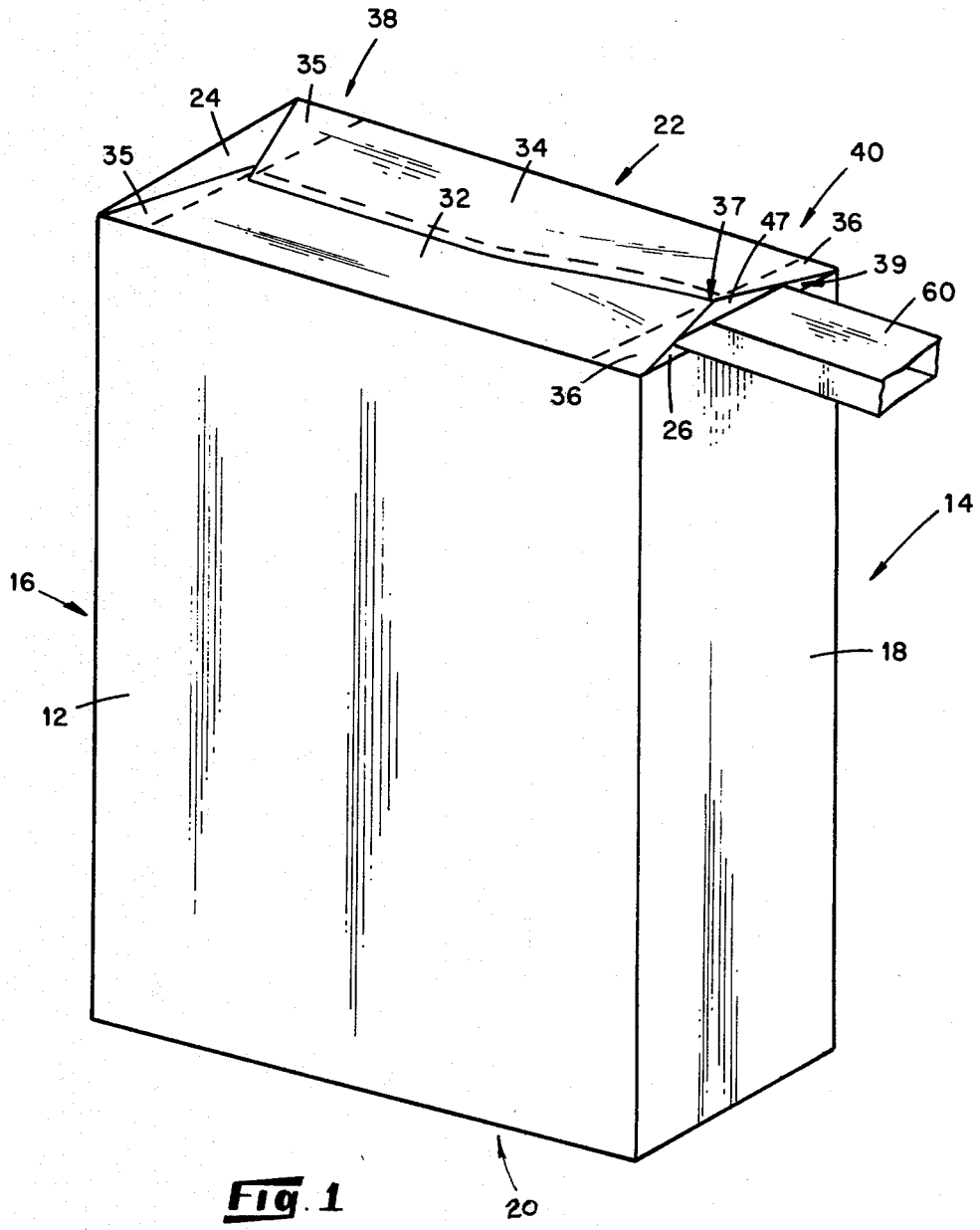
FIG. 1 is a perspective view of a bag having a filling passageway and incorporating various features of the present invention.
Figure 2:
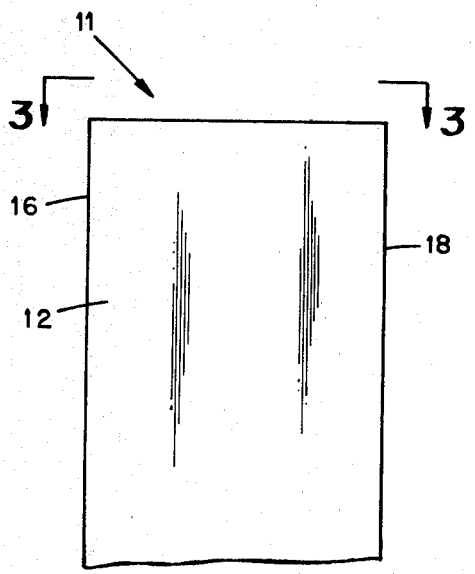
FIG. 2 is a side view of a bag tube.
Figure 3:
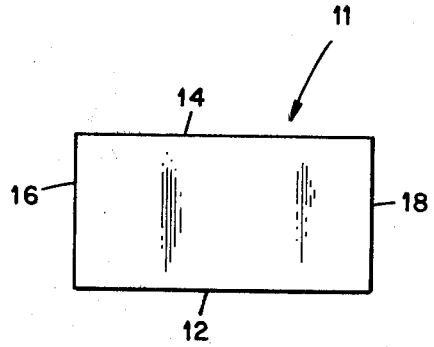
FIG. 3 is a view taken in line 3—3 of FIG. 2.

With reference to FIGS. 1 through 9, there is illustrated a bag, generally denoted by the numeral 10, having a front wall 12, a back wall 14, two side walls 16 and 18, a bottom end closure 20, and a top end closure 22.

Our improved deflecting member can be used with various bag constructions, i.e., single walled bags, multi-walled bags and the like. In order to simplify the understanding of the deflecting member, the drawings illustrate a single wall bag. However, it should be clearly understood that the deflecting member can be used with equal effectiveness in multi-walled bags.

Figure 4:
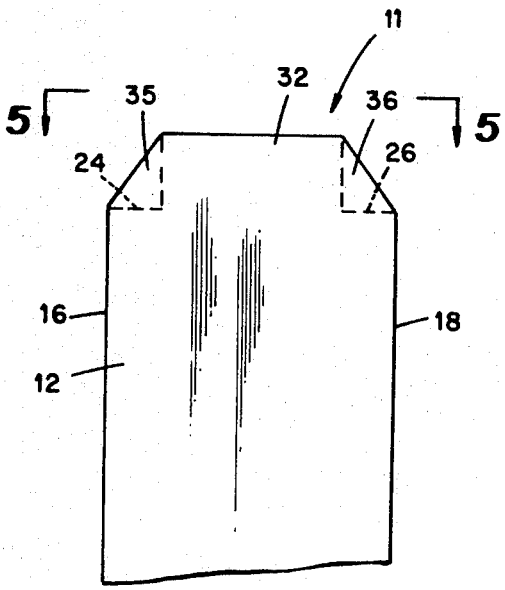
FIG. 4 is a side view of the bag after the initial side folds are made.
Figure 5:
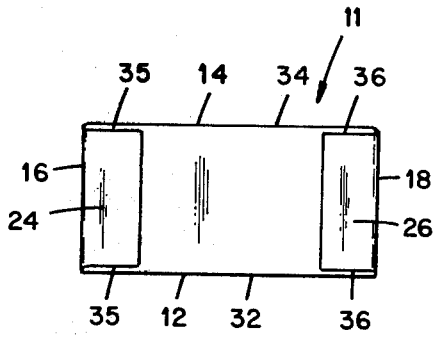
FIG. 5 is a view taken on line 5—5 of FIG. 4.
Figure 6:
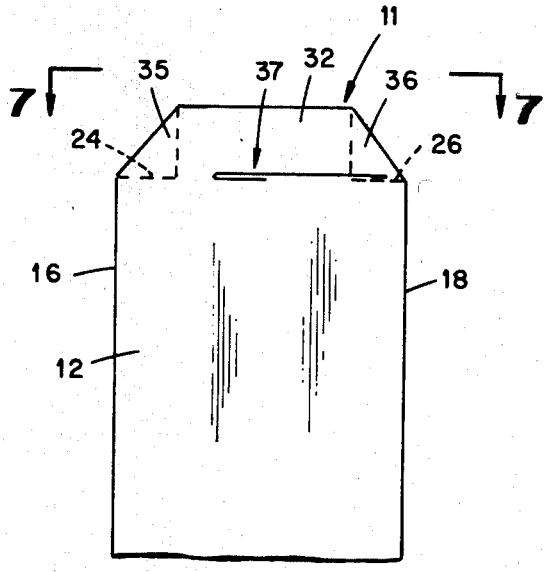
FIG. 6 is a side view of the bag after a deflecting member is inserted.
Figure 7:
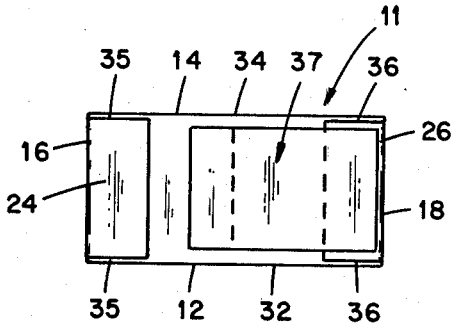
FIG. 7 is a view taken on line 7—7 of FIG. 6.
Figure 8:
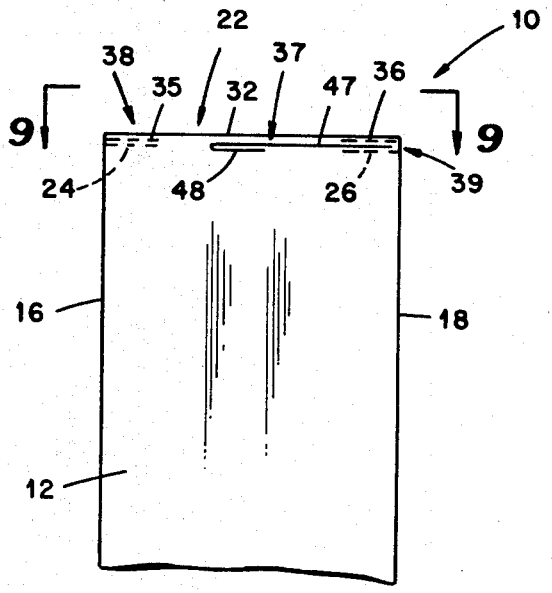
FIG. 8 is a side view of the bag after the upstanding flaps are closed.
Figure 9:
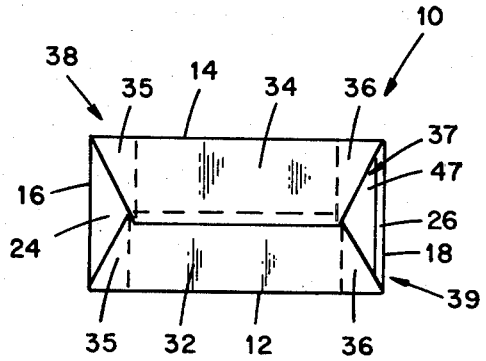
FIG. 9 is a view taken on line 9—9 of FIG. 8.
Figure 10:
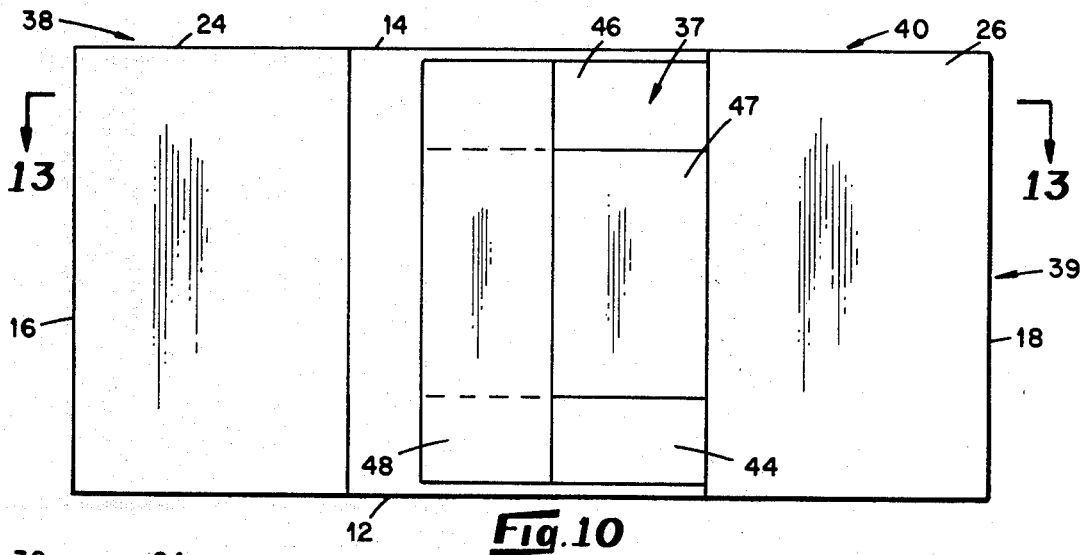
FIG. 10 is a view of the bag of FIG. 1 looking upwardly into the interior of the bag at the bottom side of the top end closure of the bag before the filling operation is started.

A typical method of construction of the top end closure 22 of the bag 10 embodying various features of our invention is schematically illustrated in FIGS. 2 through 9. The bag 10 is constructed from a bag tube 11 which preferably is formed into a generally rectangular cross-section configuration as can be best seen in FIG. 3. With reference to FIGS. 4 and 5, as a first step in forming the bag 10, the side walls 16 and 18 are folded toward each other into the bag tube 11 to form rectangular panels 24 and 26 which define the upper corners of the bag 10. Upon folding of the side walls 16 and 18, upstanding closure flaps 32 and 34 are formed which have triangular tabs 35 and 36, respectively, at each of the corners. With reference to FIGS. 6 and 7, following the formation of the rectangular panels 24 and 26, a flexible deflecting member 37, which will be subsequently described in detail, is inserted over the rectangular panel 26 and thereafter the upstanding closure flaps 32 and 34 are folded inwardly toward each other in overlapping relationship to form the top end closure 22 of the bag 10. In connection with the folding of the bag tube 11 to form the top end closure 22, adhesive or other sealing material is employed to close the seams and overlaps between the corner panel 24 and the triangular tabs 35 of the closure flaps 32 and 34 to form a sealed corner 38. As will be hereinafter described, the deflecting member 37 is adhesively united with the rectangular panel 26 and the overlapped closure flaps 32 and 34 to define a filling passageway 39 at the corner 40 of the bag 10.

The bottom closure 20 can be made in any conventional or otherwise convenient way and forms no part of the present invention.

Depending upon the number of plies of the bag material, the bag construction may be changed somewhat, but is is important that the deflecting member 37 be open between its lower surface and the upper surface of the corner panel 26 to define the filling passageway 39.

Figure 14:
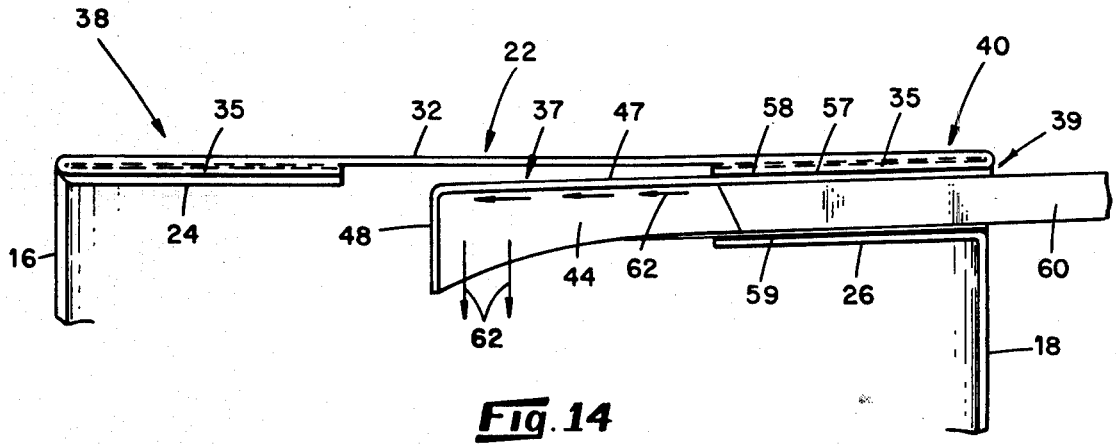
FIG. 14 is a view taken on line 14—14 of FIG. 11.
Figure 15:
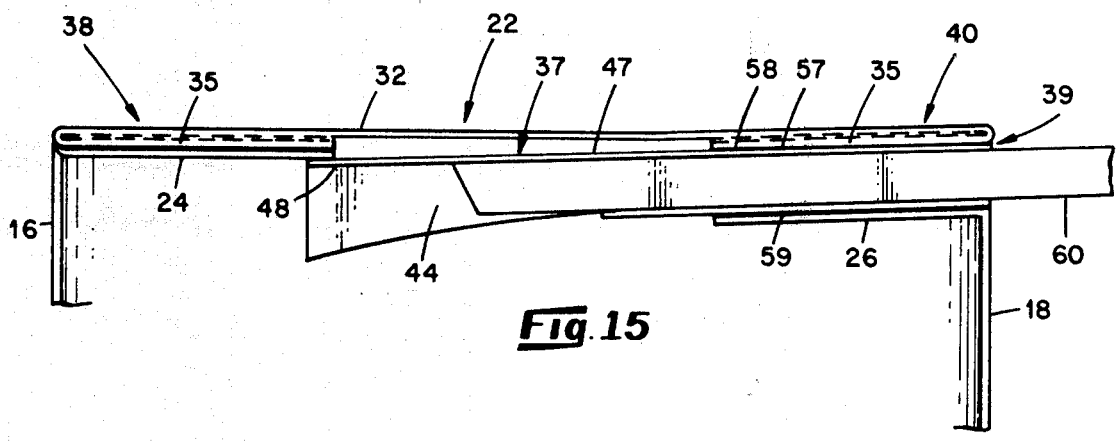
FIG. 15 is a view taken on line 15—15 of FIG. 12.
Figure 16:
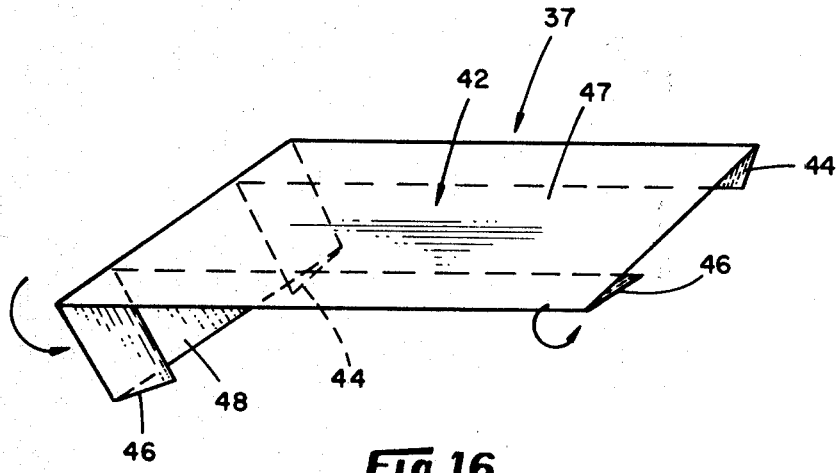
FIG. 16 is a perspective view of a deflecting member embodying various features of the present invention.

Now with additional reference to FIGS. 10 through 16, the elongated deflecting member, generally denoted as the numeral 37, is fabricated from any suitable flexible sheet material, e.g. paper, plastic or the like. Preferably, the deflecting member 37 is fabricated from kraft paper of a basis weight consistent with the bag construction. Referring to FIG. 16, the deflecting member 37 is fabricated from an elongated sheet of paper 42, or the like, which is folded along its marginal edges to provide under folded marginal flaps 44 and 46 which border a central longitudinally extending panel 47. As illustrated, the sheet 42 and the flaps 44 and 46 are underfolded transversely adjacent one of the ends of the deflecting member to provide a deflecting section 48.

The deflecting member 37 is positioned in the filling passageway 39 with the portion having the deflecting section 48 extending into the interior of the bag 10 toward the sealed corner 36. The deflecting member 37 is oriented so that the deflecting section 48 and the side flaps 44 and 46 will unfold downwardly generally away from the top end closure 22 as the bag filling operation begins. The elongated deflecting member 37 is long enough so that when it is fully extended with the deflecting section 48 unfolded and coextensive with the panel area 47, the now unfolded deflecting section 48 will overlay at least a portion of the rectangular corner panel 24 at the sealed corner of the bag.

Figure 11:
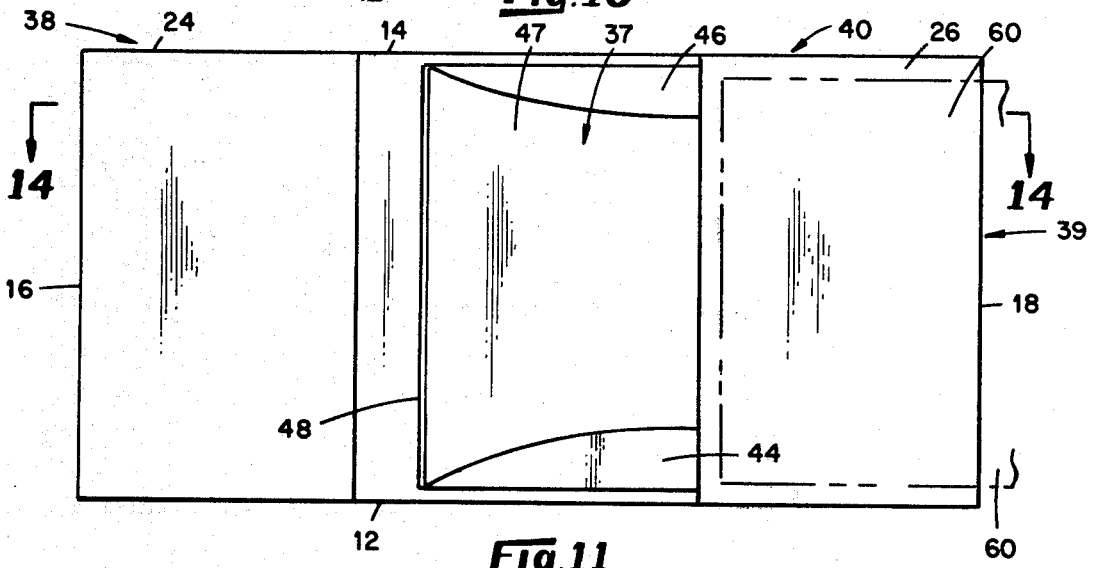
FIG. 11 is a view similar to that of FIG. 10 during the filling operation.

As can be best seen in FIGS. 8 and 13–15, the panel area 47 of the deflecting member 37 is adhesively secured, as denoted by the numeral 57, to the bottom surface 58 of the overlapped closure flaps 32 and 34 above the corner panel 26 at the corner 40. The portion of deflecting member sleeve 37 which extends beyond the corner panel 26 from the inner end of the filling passageway 39 toward the sealed corner 38 is not adhesively connected to the bag. The portion of the marginal flaps 44 and 46 which overlie the corner panel 26 at the valve corner 40 are adhesively attached as denoted by the numeral 59 in the folded under position to the corner panel 26 at the corner 40. There is no adhesive bond between the panel area 47 and the rectangular corner panel 26. This construction thus provides the filling passageway 39 between the panel 26 and the panel area 47 of the deflecting member 37. It should be noted that until the bag filling operation begins, the deflecting section 48 and side flaps 44 and 46, are folded under the panel area 47 of the deflecting member 37, as can be seen in FIGS. 11 and 14. During the bag filling operation, the deflecting section 48 and flaps 44 and 46 will unfold as will hereinafter be discussed and as can be seen in FIGS. 11 through 15.

With reference to FIG. 1, in order to fill the bag 10 with a material, a material filling spout 60 of a filling machine is inserted through the filling passageway 39 at the corner 40 of the bag 10 and the material is introduced into the bag through the filling spout 60. It should be noted that any type of reinforcement can be added to the bag at the deflecting member 37 to prevent the bag from tearing when it is suspended from a filling spout of a filling machine.

With reference to FIGS. 11 and 14, as the filling spout 60 is inserted into the filling passageway 39, defined between the panel area 47 of the deflecting member and the corner flap 26 of the bag 10, it will open the filling passageway 39 displacing the closure flaps 32, 34 away from the corner panel 26 at the corner 40. Because the panel area 47 of the deflecting member 37 is adhesively secured to the overlapped closure flaps 32, 34 and because the side flaps 44 and 46 of the deflecting member 37 are adhesively secured to the corner panel 26, the side flaps 44 and 46 will unfold in a downward direction generally away from the overlapped closure flaps 32 and 34 on either lateral side of the spout to form an opening therefor. If the filling spout 60 is inserted part way into the bag, short of the deflecting section 48 of the deflecting member 37, the material entering the bag 10 from the spout 60, indicated by flow arrows 62 in FIG. 14, will cause the side flaps 44, 46 and the deflecting section 48 of the deflecting member 37 to partially unfold and assume a position extending downwardly away from the top end closure 22 of the bag 10. The downwardly extending deflecting section 48 will direct the material coming from the spout 60 downwardly and away from the sealed corner 38. The downwardly extending side flaps 44, 46 will also deflect the material downwardly and prevent the material from flowing laterally of the deflecting member 37 toward the sealed corner 38 of the bag 10. Thus, the material entering the bag 10 from the spout 60 is channeled away from the sealed corner 38 so it can not escape through any imperfections at the sealed corner 38 of the bag.

Figure 12:
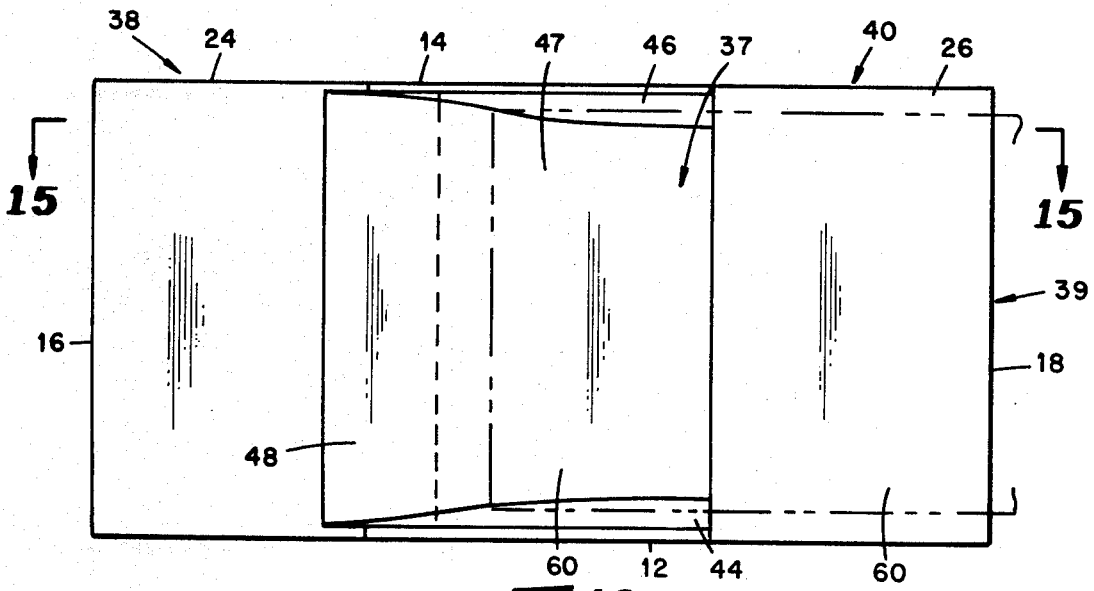
FIG. 12 is a view similar to that of FIG. 11 under a somewhat different filling operation.
Figure 13:
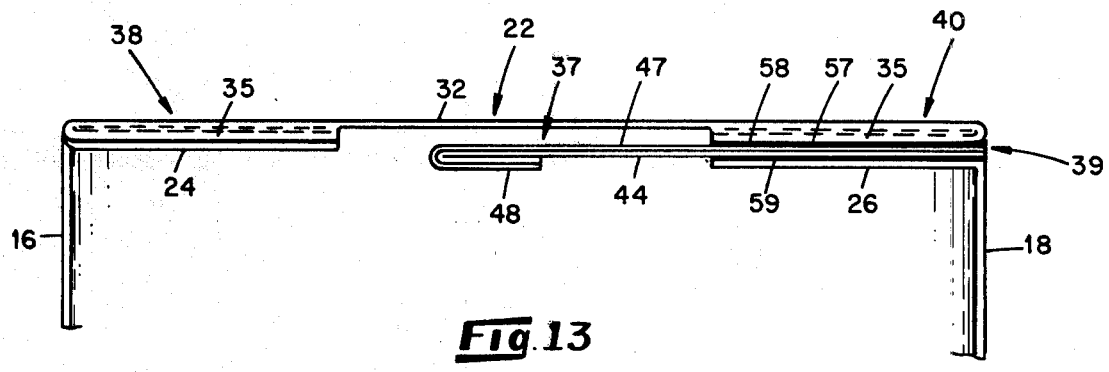
FIG. 13 is a view taken on line 13—13 of FIG. 10.

With reference to FIGS. 12 and 15, if the force of the material coming from the spout 60 is sufficient to completely unfold the deflecting section 48, or if the spout 60 is inserted far enough into the bag 10 so that it contacts the deflecting section 48, the now completely unfolded deflecting section 48 will overlie at least a portion of the corner panel 24 at the sealed corner 38 and will prevent the material from escaping through any imperfect seals at the sealed corner 38. The downwardly projecting side flaps 44 and 46 of the deflecting member 37 will deflect the material coming from the spout 60 downwardly and prevent the material from flowing laterally of the deflecting member 42 and into the sealed corner 38.

The foregoing detailed description is given primarily for clearness of understanding, and no unnecessary limitations should be understood therefrom for modifications will be obvious to those skilled in the art upon reading this disclosure and can be made without departing from the spirit of the invention or scope of the appended claims.

What is claimed:

1. In a bag having an end closure with a filling passageway at one end thereof, the improvement which comprises:

providing a deflecting member at the end of said filling passageway, said deflecting member including a section extending inwardly into said bag from the inner end of said filling passageway, said section including an inwardly extending panel having folded under flaps along its marginal edges, and the innermost end of said section being folded back upon itself, whereby when material is directed through said filling passageway it impinges on said folded end of said section to cause it and said marginal edge folded under flaps to assume a position to direct the material into the interior of said bag and away from the other end of said end closure.

2. The bag of claim 1, wherein said end of said section which is folded back upon itself is proportioned to cover seams in said end closure opposite said filling passageway when said folded back end of said section is fully extended.

* * * * *

UNITED STATES PATENT AND TRADEMARK OFFICE

CERTIFICATE OF CORRECTION

PATENT NO. : 4,361,268

DATED : November 30, 1982

INVENTOR(S) : Dennis J. Sexton and Richard J. Nadaskay

It is certified that error appears in the above—identified patent and that said Letters Patent is hereby corrected as shown below:

On the title page of the patent item [75] Inventors:

Delete "Hadaskay" and insert -- Nadaskay --.

Signed and Sealed this

Nineteenth Day of April 1983

[SEAL]

*Attest:*

GERALD J. MOSSINGHOFF

*Attesting Officer*

*Commissioner of Patents and Trademarks*